US006793555B1

(12) United States Patent
Tilbor et al.

(10) Patent No.: US 6,793,555 B1
(45) Date of Patent: Sep. 21, 2004

(54) TOY VEHICLE WITH DYNAMIC TRANSFORMATION CAPABILITY

(76) Inventors: Neil Tilbor, 4707 Van Kleeck Dr., New Smyrna Beach, FL (US) 32169; Michael G. Hetman, 6274 Engram Rd., New Smyrna Beach, FL (US) 32169; Masaki Suzuki, 2-19-11 Tokorooka Yachi Kahoku-Cho Nishimurayama-Gun, Yamagata (JP)

( * ) Notice: Subject to any disclaimer, the term of this patent is extended or adjusted under 35 U.S.C. 154(b) by 0 days.

(21) Appl. No.: 10/388,823

(22) Filed: Mar. 17, 2003

(51) Int. Cl.[7] ..... A63H 30/04
(52) U.S. Cl. ..... 446/456; 446/466; 446/465
(58) Field of Search ..... 446/454, 456, 446/457, 460, 466, 468, 469, 470, 465, 437

(56) References Cited

U.S. PATENT DOCUMENTS

| | | | | | |
|---|---|---|---|---|---|
| 3,613,307 | A | * | 10/1971 | Baynes et al. | 446/466 |
| 4,602,800 | A | * | 7/1986 | Persson | 280/6.156 |
| 4,696,655 | A | * | 9/1987 | D'Andrade et al. | 446/466 |
| 4,850,929 | A | * | 7/1989 | Genevey | 446/466 |
| 5,167,563 | A | | 12/1992 | Saffer | |
| 5,334,077 | A | | 8/1994 | Bailey | |
| 5,338,246 | A | * | 8/1994 | Suto | 446/466 |
| 5,527,059 | A | * | 6/1996 | Lee, Jr. | 446/466 |
| 5,643,041 | A | * | 7/1997 | Mukaida | 446/455 |
| 5,722,872 | A | * | 3/1998 | Simmons et al. | 446/456 |
| 5,762,533 | A | | 6/1998 | Tilbor et al. | |
| 6,036,575 | A | * | 3/2000 | Rehkemper et al. | 446/466 |
| 6,383,054 | B1 | * | 5/2002 | Rauch | 446/456 |
| 2002/0077026 | A1 | * | 6/2002 | Li | 446/466 |

* cited by examiner

*Primary Examiner*—Derris H. Banks
*Assistant Examiner*—Urszula M Cegielnik
(74) *Attorney, Agent, or Firm*—Keusey, Tutunjian & Bitetto, P.C.

(57) ABSTRACT

A toy vehicle having dynamic transformation capability includes a transformation system connected to the front and rear wheels. The front and rear wheels are pivotally mounted on front and rear swing arms, and the swing arms are in communication with the transformation system. The transformation system is radio controlled and enables the selective control of the wheel positions during operation of the vehicle. The remotely controlled selective and infinite transformation capabilities allows for changing the vehicle's wheelbase, center of gravity (cog), front/rear weight distribution, ground clearance, attitude (i.e., angle to ground plane); and the suspension travel with respect to the chassis/body in response to the terrain and driving conditions.

10 Claims, 9 Drawing Sheets

TOY VEHICLE WITH DYNAMIC TRANSFORMATION CAPABILITY

BACKGROUND OF THE INVENTION

1. Field of the Invention

The present invention relates to toy vehicles. More particularly, it relates to radio controlled toy vehicles having transformation capabilities.

2. Description of the Prior Art

Toy vehicles are well known, and remotely (radio) controlled toys vehicles have come to constitute a significant specialty toy market. There are many different types of radio controlled toy vehicles on the market, such as, for example, bicycles, motorcycles, cars, trucks and flying vehicles as well. As such, there is significant competition to create different toy vehicles, in any one of these types of vehicles, that can perform differently and provide the user with a greater variety of actions.

U.S. Pat. No. 5,762,533 discloses a toy vehicle with adjustably positioned wheels. Each wheel is mounted on separate support housings. The wheels are mounted for rotation on the housings, and which housings are mounted off center to the axis of wheel rotation. As such, the support housings rotate eccentrically around the axle with the wheels.

U.S. Pat. No. 4,696,655 discloses a toy vehicle with an adjustable suspension system. The toy vehicle includes a wheel support and suspension system that allows the user to manually lift or lower the suspension of the toy. The suspension system utilizes hollow plastic tubes which include a flexible zone with a plurality of circumferential corrugations which enable the tube to be stretched to sequential lengths until the corrugations assume a longitudinally spaced position.

SUMMARY OF THE INVENTION

It is therefore an aspect of the invention to provide a toy vehicle having dynamically configurable variable wheel positions.

It is another aspect of the invention to provide a toy vehicle that allows the user to dynamically change the wheelbase, center of gravity (cog), front/rear weight distribution, ground clearance, attitude (i.e., angle to ground plane), and 6) the suspension travel with respect to the chassis/body.

These and other aspects of the invention are achieved with a radio controlled toy vehicle having a body with front and rear ends, and a front swing arm assembly pivotally connected to the body and having at least one front mounted wheel and a steering mechanism connected to the at least one wheel and operative to steer the toy vehicle in a desired direction. A transformation system is disposed in the body and connected to the front swing arm assembly for pivoting the assembly and causing the at least one front wheel to be raised and lowered with respect to the body. Circuitry for receiving radio commands from a remote transmitter and controlling the steering mechanism and the transformation-:system is included with the vehicle body.

A rear swing arm assembly is pivotally connected to the body and connected to said transformation system. The rear swing arm assembly includes at least one rear mounted wheel and a drive mechanism connected to the at least one wheel. The drive system selectively drives said rear wheel in response to received radio control commands. The transformation system pivots the rear swing arm assembly in response to received radio control commands.

The transformation system includes transformation control motor, a front transformation gear, a rear transformation gear, and a plurality of differential gears connecting said front and rear transformation gears to said motor such that activation of said motor causes said front and rear gears to actuate said front and rear swing arm assemblies, respectively. The front transformation gear and rear transformation gear each have an output gear ratio, wherein the output gear ratios of said front and rear transformation gears are different with respect to each other.

The steering mechanism includes a steering servo mounted with said front swing arm assembly, and a steering servo tie rod operatively connected to the at least one front wheel. The steering servo tie rod being mounted with said front swing arm assembly such that steering is enabled in any pivotal position of said front swing arm assembly.

The drive mechanism includes a drive motor mounted with the rear swing arm assembly and a plurality of gears connecting the drive motor to the at least one rear wheel. The drive mechanism moves with the rear swing arm assembly during pivotal motion to enable constant driving control over the at least one rear wheel in any pivotal position of the rear swing arm assembly.

A suspension system is integrated into the pivotal connections of said front and rear swing arm assemblies and includes a suspension travel distance for each of the front and rear swing arm assemblies. The suspension travel distance for the front and rear swing arm assemblies is dependent on the pivotal position of the swing arm assemblies with respect to said body.

According to another aspect of the invention, the radio controlled toy vehicle includes a body having front and rear ends and a rear swing arm assembly pivotally connected to the body and having at least one rear mounted wheel and a drive mechanism connected to the at least one wheel operative to selectively drive the rear wheel in response to received radio control commands.

A transformation system is disposed in said body and is connected to the rear swing assembly for pivoting the same and causing the at least one rear wheel to be raised and lowered with respect to the body. The transformation system pivots the rear swing arm assembly in response to received radio control commands.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION OF PREFERRED EMBODIMENTS

Figure 1:
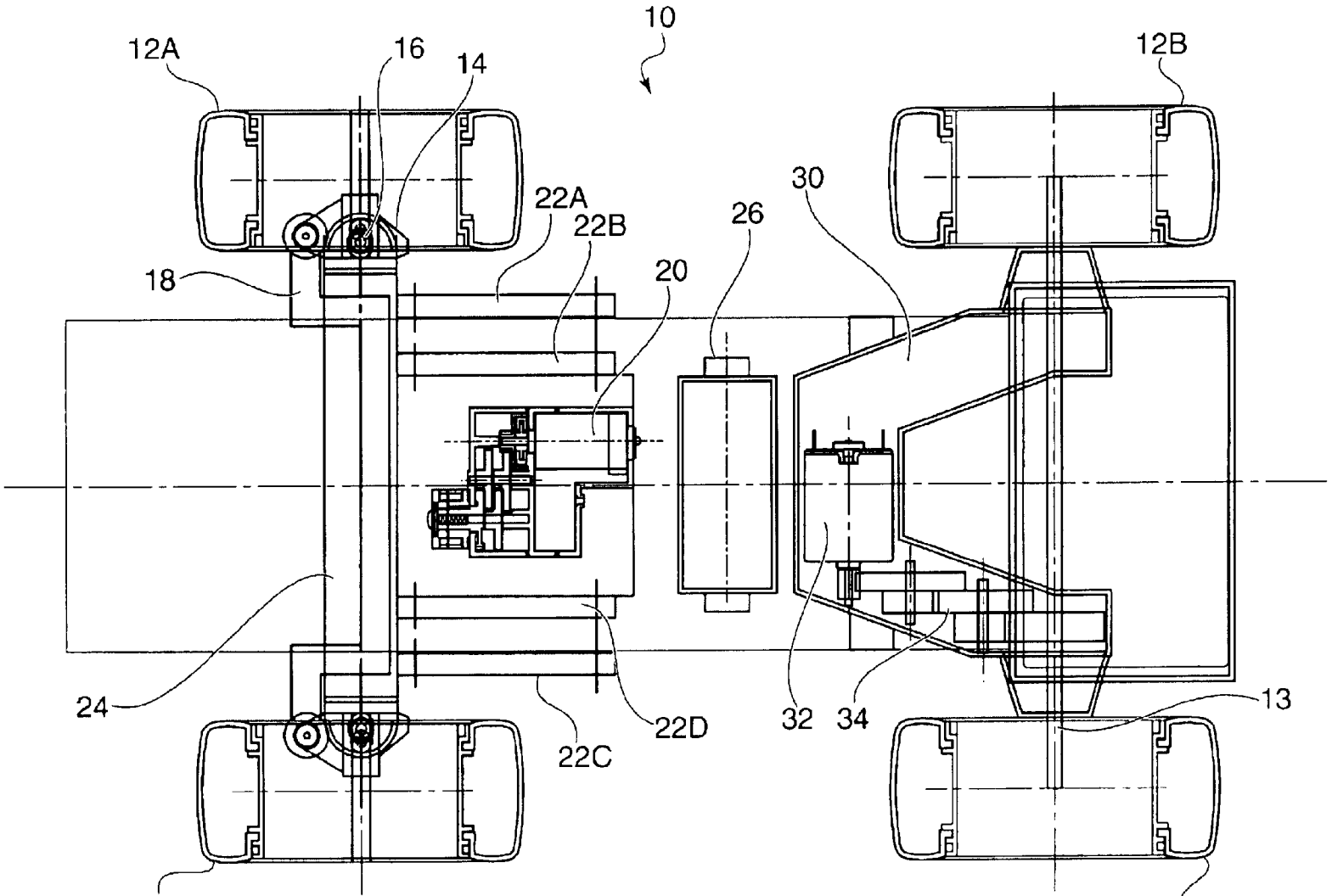
FIG. 1 is a top schematic representation of the toy vehicle according to an embodiment of the invention.

FIG. 1 shows a schematic of the toy vehicle 10 according to an embodiment of the invention. The toy vehicle 10 has front wheels 12*a* and 12*c*, and rear wheels 12*b* and 12*d*. The front wheels 12*a* and 12*c* are connected to steering servo tie rod 18 via a steering arm 16 and steering knuckle 14. The tie rod 18 and steering knuckle 14 are mounted in conjunction with a front swing arm assembly 24 that is connected to the transformation transmission (gearbox) 26 or transformation control 26. This type of steering system is commonly referred to as an Ackerman Steering system which includes a tie rod assembly. Rear wheels 12*b* and 12*d* are connected to a rear axle 13 that is rotatably mounted within a rear swing arm assembly 30. The vehicle 10 is a radio controlled toy and includes all necessary radio control electronics within body 11 (not shown). Those of ordinary skill will recognize that the placement of the RC electronics can be a matter of design choice, and in this application is preferably above the transformation gearbox 26, (i.e., in the cab/forward portion of bed area). Those of ordinary skill in the art will also recognize that the position of the r/c electronics can be modified without departing from the spirit of the present invention.

Rear swing arm assembly 30 is connected to the transformation gearbox 26 for pivotal movement and also includes a rear wheel drive motor 32 and drive gearing 34 which together enable the selective rotation of rear axle 13 and thereby wheels 12*b* and 12*d*.

Figure 2:
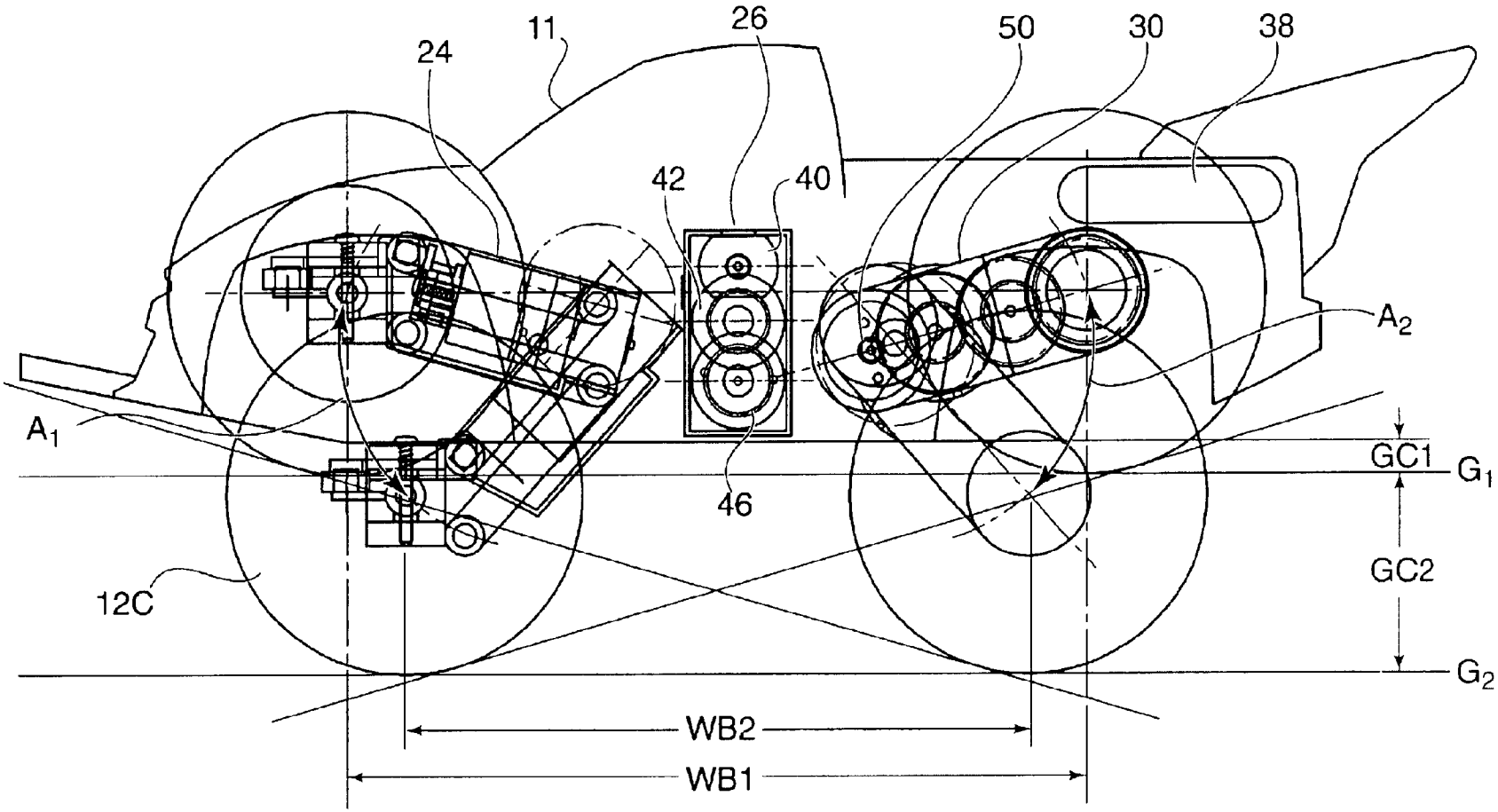
FIG. 2 is a side schematic view of the toy vehicle according to an embodiment of the invention.
Figure 3:
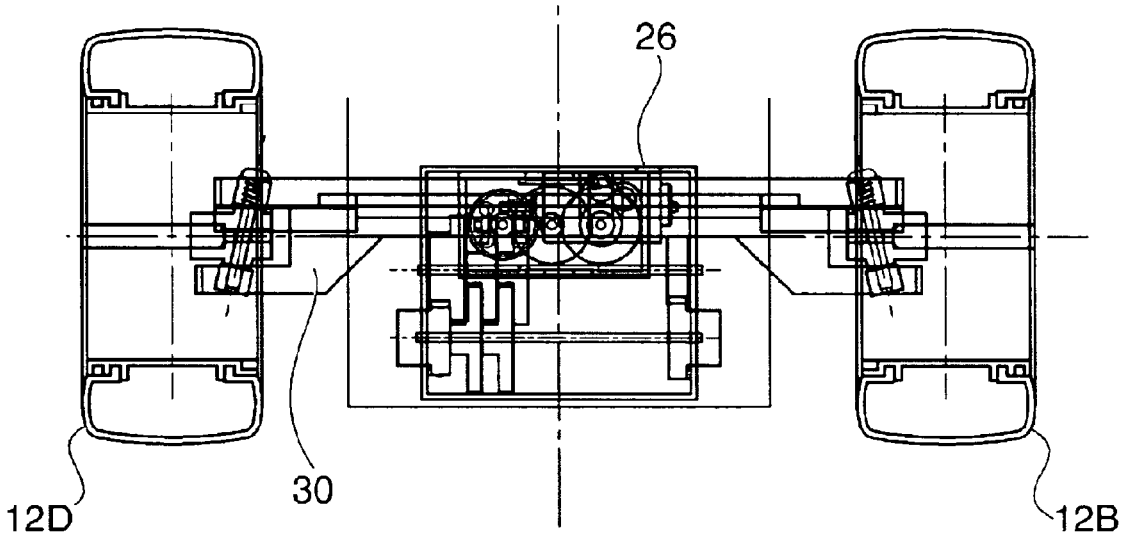
FIG. 3 is a rear schematic view

FIG. 2 shows a schematic representation of the toy vehicle 10 showing extreme positions of the wheels 12 with respect to the vehicle chassis/body 11. By way of example, when chassis/body 11 is closest to the ground level $G_1$, wheels 12 are in their highest operable position (with respect to the chassis/body 11). After one mode of transformation (to be discussed below), transformation transmission gearbox 26 causes rear swing arm 30 and front swing arm assembly 24 to move or pivot downward along arcs $A_2$ and $A_1$, respectively, such that wheels 12 are forced downward against the ground thereby causing chassis/body 11 to be lifted off the ground, thereby significantly increasing the clearance between the ground level $G_2$ and the bottom of the chassis/body 11. According to one aspect of the invention, the vehicle's ground clearance is variable up to 530% from a minimum ground clearance, GC1 of ⅜ inches to a maximum ground clearance, GC2 of 2.5 inches. The ability to dynamically vary the ground clearance of vehicle 10 by radio control while the vehicle is moving changes the vehicle's: 1) wheelbase; 2) center of gravity (cog); 3) front/rear weight distribution; 4) ground clearance; 5) attitude (i.e., angle to ground plane); and 6) the suspension travel with respect to the chassis/body, and also enables the vehicle to traverse over many obstacles without difficulty. This is especially true at maximum ground clearance GC2.

The transformation gearbox/control 26 is connected to both the front swing arm assembly 24 and rear swing arm assembly 30 and includes a motor 40 and a plurality of gears that enable the movement of both swing arm assemblies.

The dynamic transformation capability of vehicle 10 increases the driving, stunt and over versatility of the toy and allows the user to vary the vehicle's wheelbase, center of gravity (cog), front/rear weight distribution, ground clearance, attitude (i.e., angle to ground plane) and the suspension travel depending on the particular driving conditions. For example, when the chassis/body 11 is raised (or wheels 12 lowered), not only is the overall ground clearance of the vehicle is increased, the suspension travel is also increased, which enables the vehicle to traverse through rough terrain and over larger obstacles. When the chassis/body 11 is lowered (or wheels 12 raised), the center of gravity of the vehicle is lowered, and the suspension travel in the vehicle is substantially eliminated. In this mode, the overall stability and handling of the vehicle is increased which optimized the vehicle for high speed operation, particularly on smooth terrains.

By enabling the user to selectively and dynamically change the wheelbase, center of gravity (cog), front/rear weight distribution, ground clearance and attitude (i.e., angle to ground plane) of the vehicle during operation (i.e., the positions of the wheels with respect to the chassis/body, and the location of the center of gravity), the variety of stunts and versatility in operation of the vehicle of the present invention surpasses all existing designs and vehicles currently on the market.

FIGS. 4 through 7 show the various extreme positions that vehicle 10 can attain resulting from the dynamic transformation system. The transformation of vehicle 10 from one operating mode to another enhances the versatility and overall performance of the vehicle. These enhancements and versatility come in the form of never seen before dynamic capabilities that are otherwise generally fixed and dependent on the wheelbase, center of gravity (cog), front/rear weight distribution, ground clearance and attitude (i.e., angle to ground plane) of the vehicle.

Figure 4:
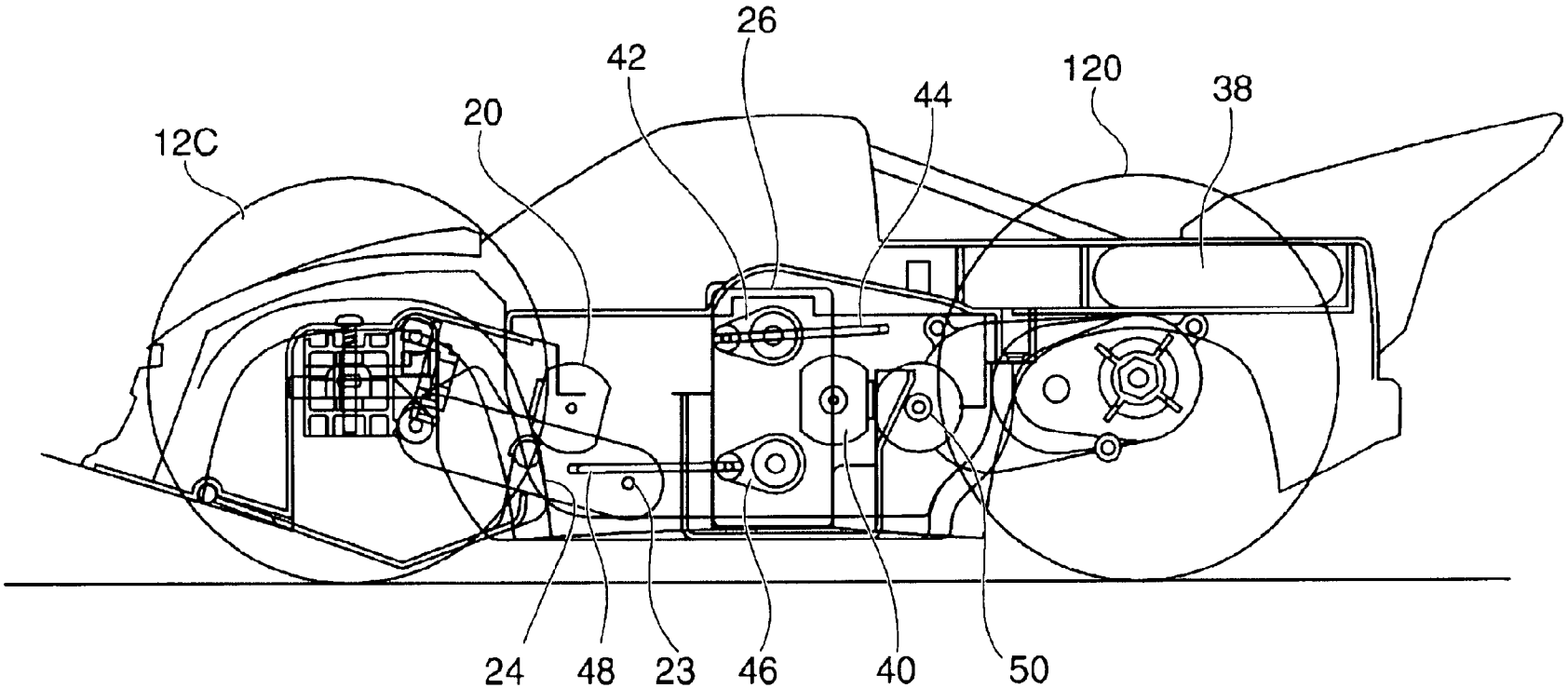
FIG. 4 is a side schematic view of the toy vehicle in one of many operable positions according to an embodiment of the invention.

FIG. 4 shows vehicle 10 with the chassis/body 11 in the lowest position with respect to wheels 12. In this mode, wheels 12 are all the way up, or in their highest upward position with respect to the chassis/body 11. In this position, the center of gravity of the vehicle 10 is lowered to the lowest possible point, the suspension travel of the wheels 12 is reduced and the overall wheelbase WB is increased to the vehicle's maximum possible wheelbase WB1 (See FIG. 2). The combination of these dynamic vehicle changes inherently increases the overall stability of the vehicle and enhances high speed handling and operation on high traction and/or smooth surfaces.

The transformation transmission gearbox 26 includes a transformation motor 40 and at least front and rear transformation cams 46 and 42, respectively. In one embodiment, the front transformation cam 46 is connected to a front transformation tie rod 48 that is connected to the front swing arm assembly 24 pivotally mounted 23 within the chassis/body 11. Thus, the rotation of cam 46 causes transformation tie rod 48 to push or pull on the pivotally mounted front swing arm assembly 24, thereby causing the same to move along a predetermined arc $A_1$ (See FIG. 2). The radius of the Arcs $A_1$ and $A_2$ can be varied according to design choice, vehicle body type and/or intended uses. A rear transformation cam 42 is connected to a rear transformation tie rod 44. The rear wheel swing arm assembly 30 is pivotally mounted within chassis/body 11 and is connected to the rear transformation tie rod 44 and rear swing arm assembly pivot point 50. Thus, when cam 42 rotates tie rod 44 pushes or pulls on the pivotally mounted rear swing arm 30 and causes the same to move along the arc $A_2$ (See FIG. 2). During dynamic operation the user may position rear wheels 12*b* and 12*d* anywhere along the arc $A_2$ to accommodate their operation preference. This transformation may be performed on the fly (i.e., during operation of the vehicle by remote/radio control.

Figure 8:
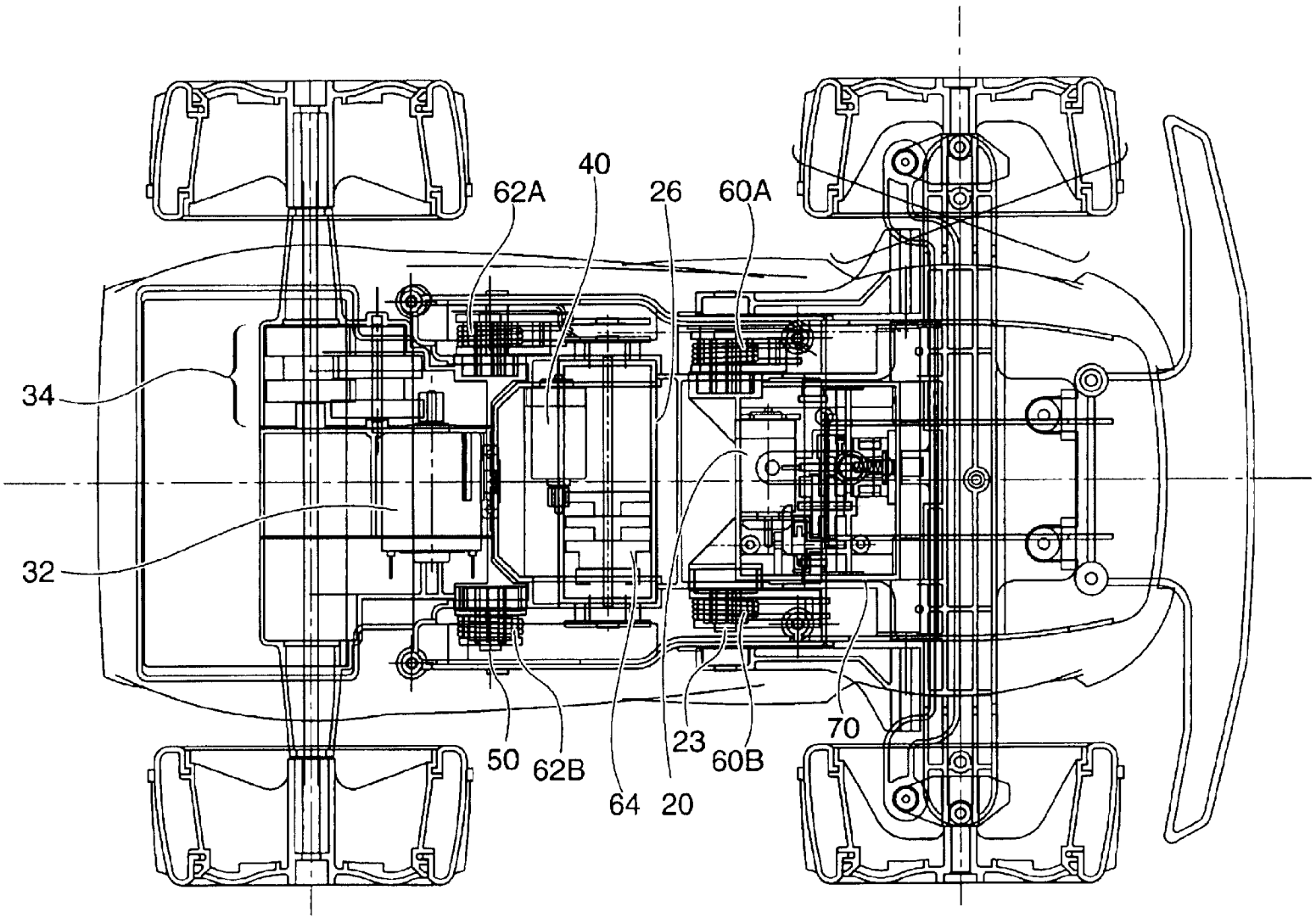
FIG. 8 is a top schematic view of the toy vehicle according to an embodiment of the invention.
Figure 9:
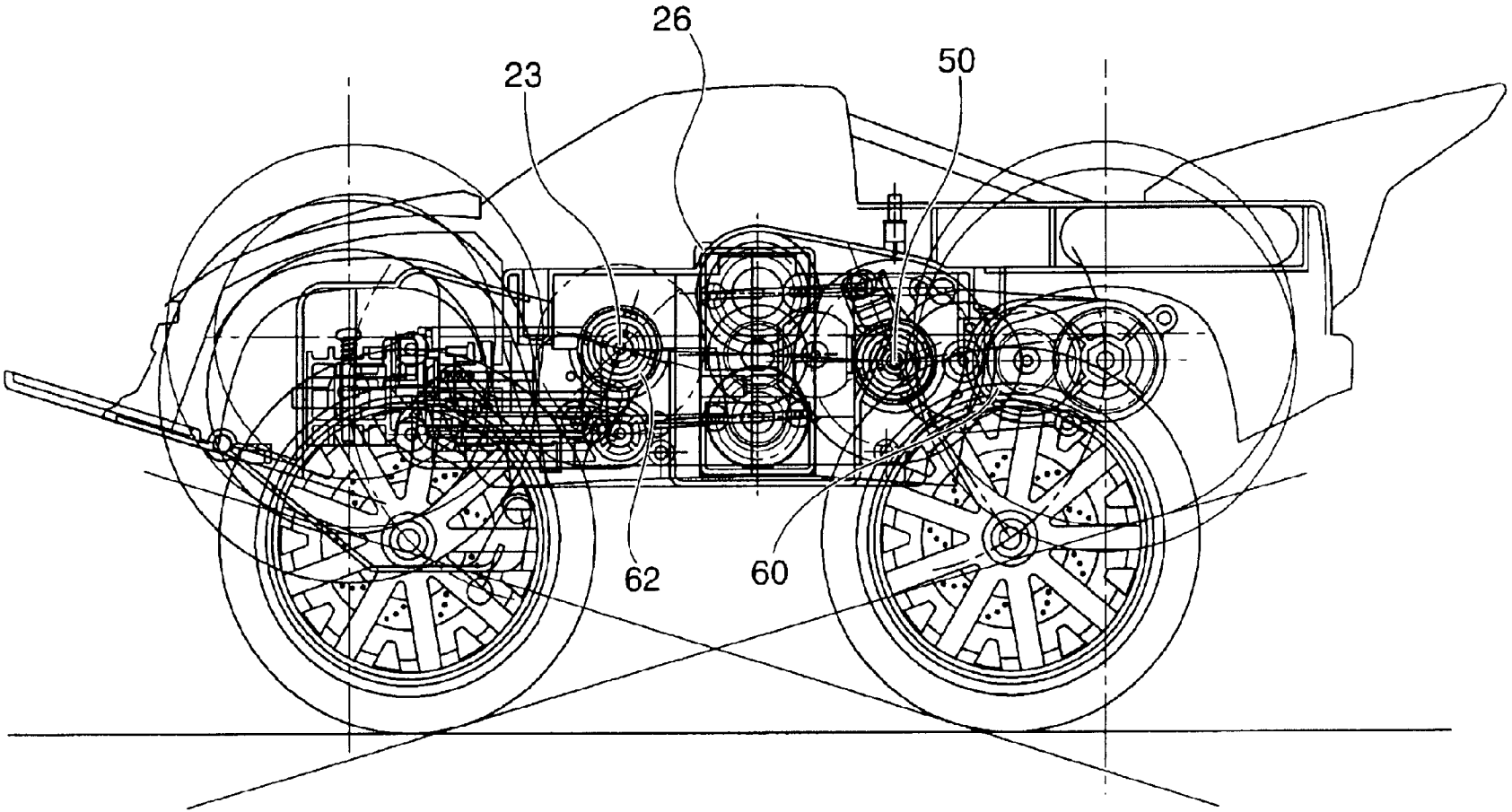
FIG. 9 is a side schematic view of the toy vehicle according to an embodiment of the invention.

A suspension system is integrated into the front and rear swing arm assemblies 24 and 30, respectively. The suspension system generally consists of springs 60 and 62 (FIG. 8) that are positioned about the front and rear pivot points 23 and 50, respectively. The spring loading of the swing arm assemblies about their respective pivot points provides a shock absorbing effect for the respective swing arm assembly and thereby the entire vehicle. The amount of shock absorbing effect, or "suspension travel" is dependent on the swing arm assembly position along their respective arcs $A_1$ and $A_2$ during any given operating mode. This feature of the present invention gives the user significant control over the suspension dynamics of the vehicle 10 and can be varied by the use to accommodate and maximize the vehicles performance for just about any terrain condition.

In accordance with one aspect of the invention, the transformation gearbox/control motor 40 is operatively engaged with gearing 64 (FIG. 8) that rotates both the front 46 and rear 42 transformation cams. In this embodiment, the output ratios of the front and rear gearing are different, and operate in such a way that the transformation of the vehicle is continuously variable. In this form, as the front 46 and rear 42 transformation cams of different output ratios rotate, they will variably come into and out of sync with each other. This continuously variable action and synchronization and asynchronization of the front/rear transformation gears enables an infinite range of operating movement using a simple mechanism. Although the output ratios of the front and rear cams are different, the front/rear gearing ratio of the respective cams is fixed with respect to each other such that the cams rotate at speeds different from one another. This allows every combination of front/rear pivot arm positions with simple controls. Those of ordinary skill will recognize that the ratios of the cams and transformation gearbox gears can be changed to accommodate various different transformation operations or preferences.

Figure 5:
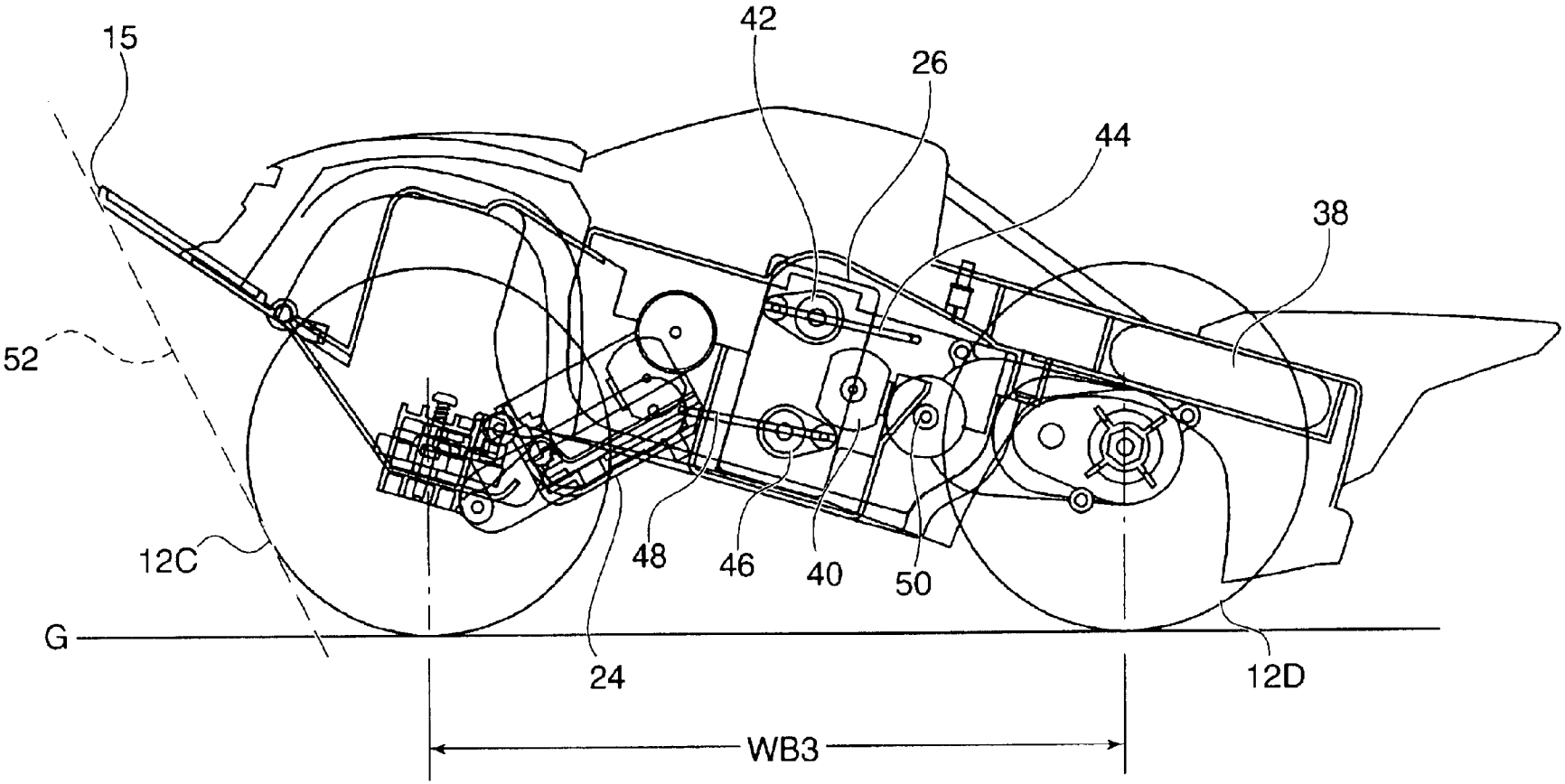
FIG. 5 is a side schematic view of the toy vehicle in one of many operable positions according to an embodiment of the invention.

FIG. 5 shows vehicle 10 where the front wheels 12*c* and 12*a* are in their lowest position with respect to chassis/body 11 (i.e., highest with respect to the ground G), while rear wheels 12*b* and 12*d* are in their highest position with respect to chassis/body 11 (i.e., lowest with respect to the ground). The front transformation cam 46 is connected to the front transformation tie rod 48 which is connected to the pivotally mounted front swing arm 24. Thus, when transformation is activated through transformation transmission gearbox 26, front transformation cam 46 is rotated, thereby causing front transformation tie rod 48 to act on front swing arm 26. The pivotal movement of front swing arm 26 is predetermined along an arc $A_1$ (See FIG. 2). In the extreme operating position shown in FIG. 5, the front end 15 of vehicle chassis/body 11 is significantly higher than the rear end, thus enabling the vehicle to more easily climb over large obstacles and clear larger ramp angles for jumps. In addition the wheelbase WB3 has been changed as well. By raising the front end 15 as shown, the suspension travel in the front wheels 12*a* and 12*c* is at its maximum height. This not only aides in the climbing ability of the vehicle, but also allows the vehicle to traverse inclined surfaces 52 (e.g., jumps) without the front 15 of chassis/body 11 hitting the inclined surface before the front wheels 12*a* and 12*c* engage the same. By way of example, a substantially inclined surface 52 is shown such that wheels 12*c* and 12*a* (not shown) engage the surface while front end 15 clears the surface 52 and allows the vehicle to proceed up the incline un-obstructed. When vehicle 10 is brought into contact with an inclined surface (such as surface 52 shown), the increased suspension travel of the front wheels 12*a* and 12*c* facilitates the toys ability to hit the incline (e.g., at increased speeds) without bouncing off or losing control.

The arcs $A_1$ and $A_2$ are the arcs along which the front and rear axles, respectively, move during dynamic transformation. The transformation (or pivoting) of front swing arm assembly 24 along arc $A_1$ and rear swing arm assembly 30 along arc $A_2$ can be controlled by the user. That is, the user controls the operating position of the vehicle and thereby controls the wheel positions anywhere along arc $A_1$ and $A_2$ on the fly (i.e., during operation) or while standing still.

When vehicle 10 is in the operating mode shown in FIG. 5, the shift in weight distribution over the rear axle has the effect of increasing the drive traction of the vehicle. Battery pack 38 is disposed in the read of chassis/body 11 and helps to increase the weight shift over the rear axle when the transformation into this operating mode is performed. In addition, the increased drive traction enables the vehicle to perform a wheel stands (wheelies) under high acceleration, and perform other drive stunts that are otherwise more difficult or impossible based on the weight distribution of the vehicle and the location of the center of gravity.

Figure 6:
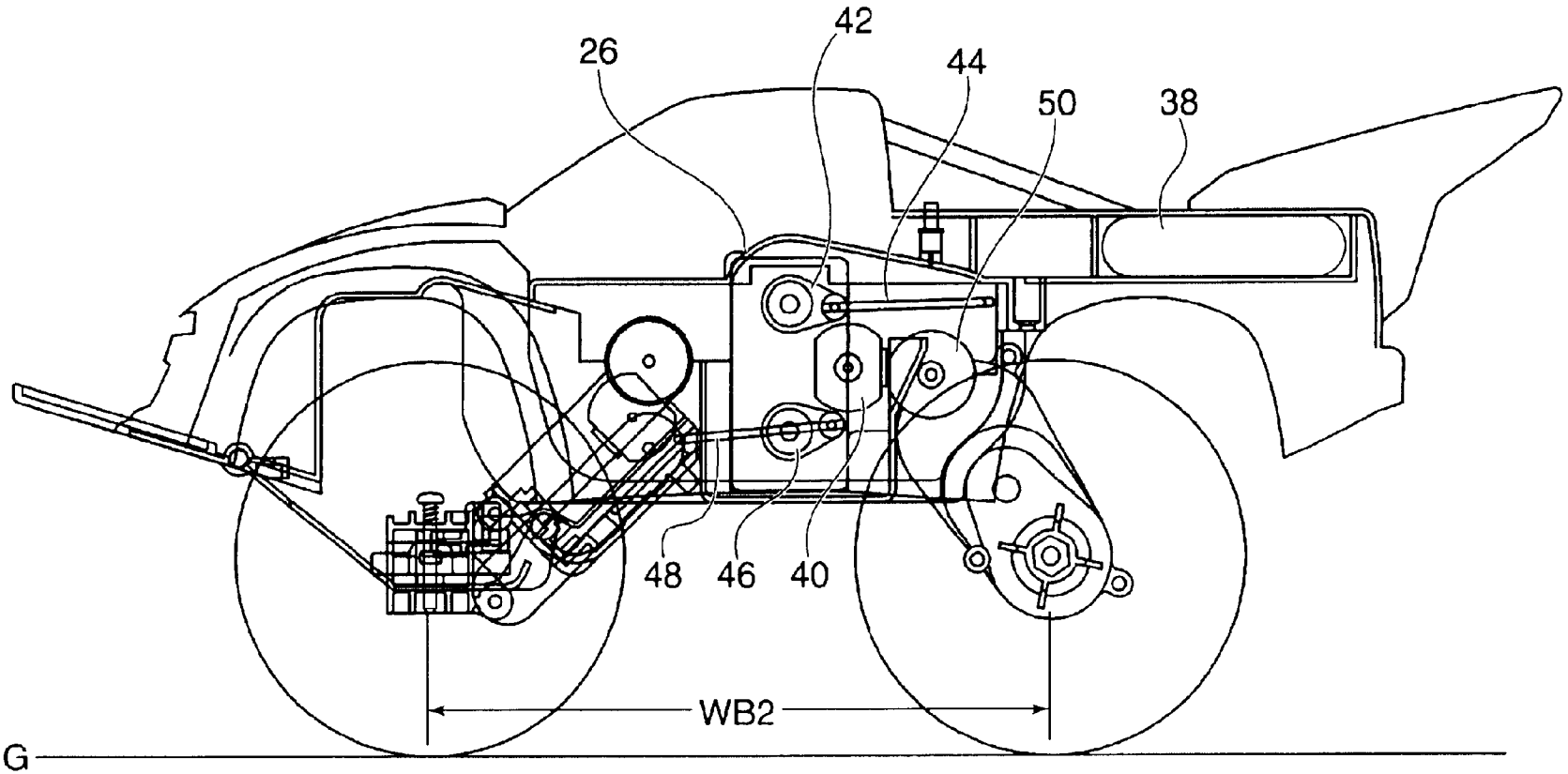
FIG. 6 is a side schematic view of the toy vehicle in one of many operable positions according to an embodiment of the invention.

FIG. 6 shows vehicle 20 in the extreme up position shown in FIG. 2 where the wheelbase WB2 is the shortest possible for the vehicle, yet the suspension travel is at its greatest. As shown, when the transformation motor is rotated, the rear transformation cam 42 rotates such that rear transformation tie rod 44 pushes on rear swing arm 30 and causes the same to pivot wheels 12*d* and 12*b* downward. In this operation position, wheels 12 are extended downward as far as possible and thereby increase the ground clearance of chassis/body 11 with respect to the ground level G. This allows the vehicle 10 to traverse and climb over obstacles and handle rough or even wet terrains without difficulty.

Figure 7:
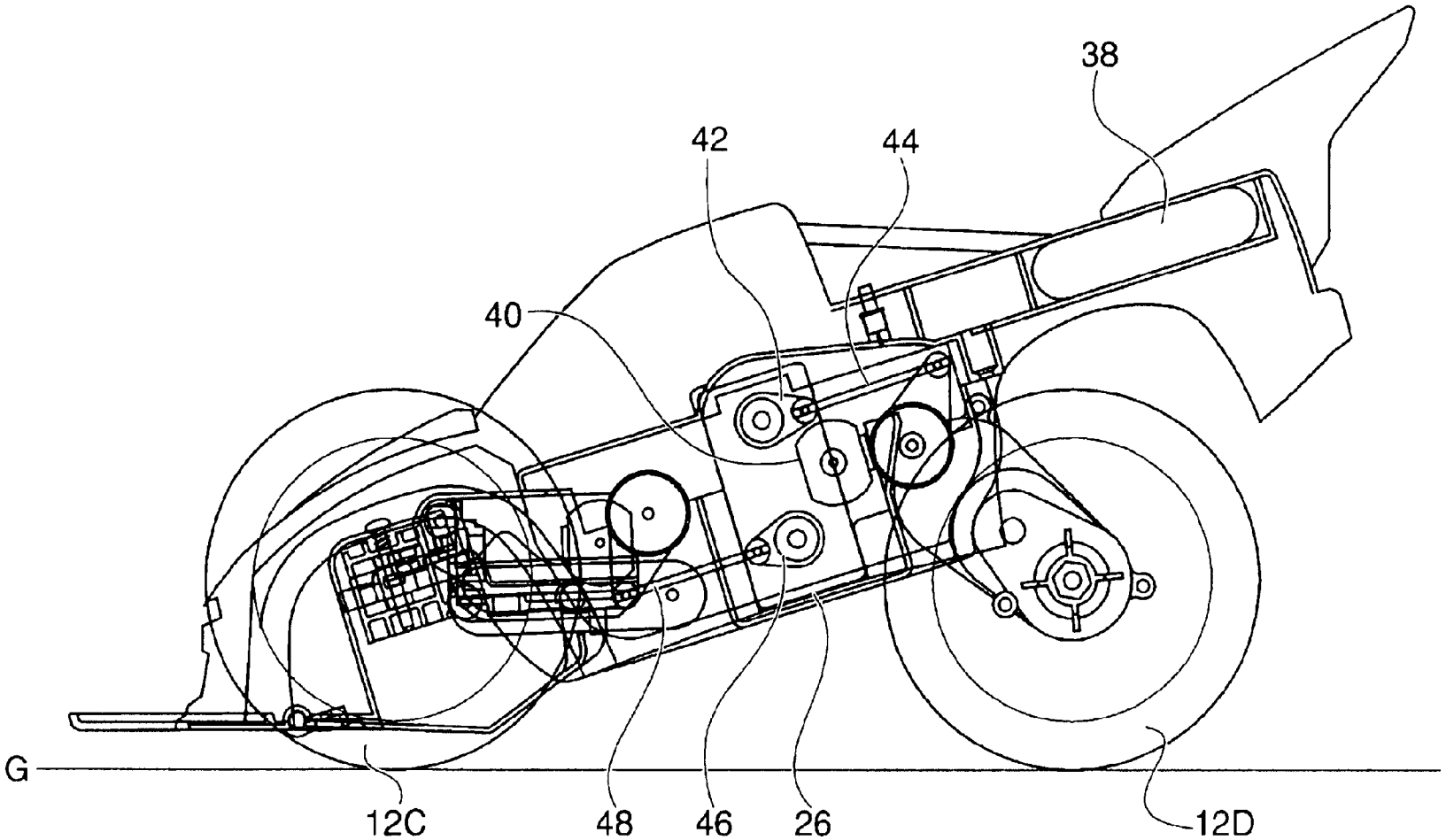
FIG. 7 is a side schematic view of the toy vehicle in one of many operable positions according to an embodiment of the invention.

FIG. 7 shows another extreme operating mode where front wheels 12*a* and 12*c* are positioned as high as possible with respect to chassis/body 11 (i.e., lowest to the ground level with the lowest possible suspension travel), while rear wheels 12*b* and 12*d* are positioned as low as possible with respect to chassis/body 11 (i.e., highest to the ground level with the highest possible suspension travel). This is a "dragster" style mode that is similar to other genres of toy vehicles. In this mode, the weight shift is toward the front of the vehicle, however based on the unique placement of battery 38, when the rear end of the vehicle is raised as shown, the weight of the battery is shifted forward further over the rear axle, thus increasing traction in what would otherwise be considered a decreased traction position. This concept is slightly counter-intuitive, however those of ordinary skill will recognize that the placement of battery 38 as shown will result in the described effect. In this mode of operation (i.e., position shown in FIG. 7), the vehicle is best suited for drag style racing and maneuvers on smoother operating surfaces.

While there have been shown, described and pointed out fundamental novel features of the invention as applied to preferred embodiments thereof, it will be understood that various omissions, substitutions and changes in the form and details of the methods described and devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed, described or suggested form or embodiment as a general matter of design choice. It is the intention, therefore, to be limited only as indicated by the scope of the claims appended hereto.

What is claimed is:

1. A radio controlled toy vehicle comprising:

a body having front and rear ends;

a front swing arm assembly pivotally connected to the body and having two front mounted wheels and a steering mechanism connected to said two front mounted wheels and operative to steer the toy vehicle in a desired direction;

a rear swing arm assembly pivotally connected to the body and having two rear mounted wheels and a drive mechanism connected to said two rear mounted wheels to drive said two rear mounted wheels in response to received radio control commands;

a transformation system disposed in said body and connected to said front swing arm assembly and said rear swing assembly for pivoting said assemblies and causing said two front mounted wheels and said two rear mounted wheels to be raised and lowered with respect to said body; and circuitry for receiving radio commands from a remote transmitter and controlling said steering mechanism and said transformation system in response to received radio control commands, wherein said transformation system pivots the front swing arm assembly so as to always raise and lower said two front mounted wheels in a non-driven dependent relationship with respect to each other and pivots the rear swing arm assembly so as to always raise and lower said two rear mounted wheels in a driven dependent relationship with respect to each other, and wherein the non-driven dependent relationship of the two front mounted wheels is independent of the driven dependent relationship of the two rear mounted wheels with respect to wheel elevations.

2. The toy vehicle according to claim 1, wherein said transformation system comprises:

a transformation control motor;

a front transformation gear;

a rear transformation gear; and a plurality of differential gears connecting said front and rear transformation gears to said motor such that activation of said motor causes said front and rear gears to actuate said front and rear swing arm assemblies, respectively.

3. The toy vehicle according to claim 2, wherein said front transformation gear and said rear transformation gear each have an output gear ratio, wherein the output gear ratios of said front and rear transformation gears are different with respect to each other.

4. The toy vehicle according to claim 3, wherein the output gear ratios of said front and rear transformation gears being different with respect to each other results in a continuously variable transformation of the toy vehicle during an operation thereof.

5. The toy vehicle according to claim 3, wherein the output gear ratios of said front and rear transformation gears being different with respect to each other results in a continuously variable transformation of the toy vehicle during an operation thereof such that at least one of said two front mounted wheels is at a different elevation than at least one of said two rear mounted wheels.

6. The toy vehicle according to claim 5, wherein the one of said two front mounted wheels is at a different elevation that the other one of said two rear mounted wheels and are on opposing sides of said body.

7. The toy vehicle according to claim 1, wherein said steering mechanism comprises a steering servo mounted on said front swing arm assembly, and a steering servo tie rod operatively connected to said at least one front wheel, said steering servo tie rod mounted with said front swing arm assembly such that steering is enabled in any pivotal position of said front swing arm assembly.

8. The toy vehicle according to claim 1, wherein said drive mechanism comprises a drive motor mounted with said rear swing arm assembly and a plurality of gears connecting said drive motor to said at least one rear wheel, said drive mechanism moving with said rear swing arm assembly during pivotal motion to enable constant driving control over said at least one rear wheel in any pivotal position of said rear swing arm assembly.

9. The toy vehicle according to claim 1, further comprising a suspension system integrated into the pivotal connections of said front and rear swing arm assemblies.

10. The toy vehicle according to claim 9, wherein said suspension system has a suspension travel distance for each of said front and rear swing arm assemblies, the suspension travel distance for said front and rear swing arm assemblies being dependent on the pivotal position of said swing arm assemblies with respect to said body.

* * * * *